US011215412B2

(12) United States Patent
Spangler et al.

(10) Patent No.: US 11,215,412 B2
(45) Date of Patent: Jan. 4, 2022

(54) FREE-FLOATING DEAD MASS BLOWBACK BOLT CARRIER

(71) Applicant: Daniel Defense, Inc., Black Creek, GA (US)

(72) Inventors: Julian James Spangler, Savannah, GA (US); Marvin C. Daniel, Pooler, GA (US)

(73) Assignee: DANIEL DEFENSE, LLC, Black Creek, GA (US)

( * ) Notice: Subject to any disclaimer, the term of this patent is extended or adjusted under 35 U.S.C. 154(b) by 0 days.

(21) Appl. No.: 16/670,436

(22) Filed: Oct. 31, 2019

(65) Prior Publication Data

US 2020/0240726 A1 Jul. 30, 2020

Related U.S. Application Data

(60) Provisional application No. 62/770,578, filed on Nov. 21, 2018.

(51) Int. Cl.
*F41A 3/26* (2006.01)

(52) U.S. Cl.
CPC ..... *F41A 3/26* (2013.01)

(58) Field of Classification Search
CPC ..... F41A 3/26; F41A 3/56; F41A 3/64; F41A 3/70; F41A 3/78; F41A 5/10; F41A 5/24; F41C 27/22
USPC ..... 42/16, 69.02, 97; 89/198
See application file for complete search history.

(56) References Cited

U.S. PATENT DOCUMENTS 5,726,377 A * 3/1998 Harris ..... F41A 19/14 42/65
6,829,974 B1 * 12/2004 Gwinn, Jr. ..... F41A 3/70 89/130
6,848,351 B1 * 2/2005 Davies ..... F41A 3/94 89/191.01
6,931,978 B1 * 8/2005 Dionne ..... F41A 3/12 42/69.02
6,971,202 B2 * 12/2005 Bender ..... F41A 3/36 42/16
7,055,276 B2 * 6/2006 McPherson ..... F41C 27/22 188/381
8,943,947 B2 * 2/2015 Gomez ..... F41C 23/06 89/191.01

(Continued)

OTHER PUBLICATIONS

David Tubb, SpeedLock Systems CWS, Feb. 15, 2017, Superior Shooting Systems, pp. 1-3 (Year: 2017).*

(Continued)

*Primary Examiner* — Troy Chambers
*Assistant Examiner* — Benjamin S Gomberg
(74) *Attorney, Agent, or Firm* — Merchant & Gould P.C.

(57) ABSTRACT

A bolt carrier may be provided. The bolt carrier may comprise a counter-bore, a housing, a cap, and a free-floating mass. The counter-bore may be disposed in the bolt carrier. The housing may be disposed in the counter-bore. The housing may have an interior, a first end, and a second end. The cap may be disposed at the second end of the housing and may be connected to the bolt carrier. The free-floating mass may be slidably disposed in the housing. A length of the free-floating mass may be less than a length of the interior of the housing between the cap and the first end.

20 Claims, 3 Drawing Sheets

(56) References Cited

U.S. PATENT DOCUMENTS

| | | | | |
|---|---|---|---|---|
| 9,038,525 | B2 * | 5/2015 | Sullivan | F41A 13/12 89/193 |
| 9,488,423 | B2 * | 11/2016 | Sullivan | F41A 3/14 |
| 9,879,930 | B2 * | 1/2018 | Cassels | F41A 3/84 |
| 2005/0260545 | A1 * | 11/2005 | Schavone | F41A 33/06 434/18 |
| 2009/0151213 | A1 * | 6/2009 | Bell | F41A 19/15 42/69.03 |
| 2016/0370135 | A1 * | 12/2016 | Plumb | F41A 3/82 |
| 2017/0115078 | A1 * | 4/2017 | Plumb | F41A 3/26 |
| 2017/0160027 | A1 * | 6/2017 | Gangl | F41A 3/70 |
| 2017/0370663 | A1 * | 12/2017 | Rood, Jr. | F41A 5/18 |
| 2018/0266782 | A1 * | 9/2018 | Bender | F41A 19/31 |

OTHER PUBLICATIONS

Tom Beckstrand, Surefire Optimized Bolt Carrier Assembly, Jul. 20, 2018, Guns and Ammo, pp. 1-8 (Year: 2018).*

Pete, Master of Arms Nyx Bolt Carrier Group, Apr. 25, 2017, The Firearm Blog, pp. 1-5 (Year: 2017).*

* cited by examiner

FREE-FLOATING DEAD MASS BLOWBACK BOLT CARRIER

RELATED APPLICATION

Under provisions of 35 U.S.C. § 119(e), Applicant claims the benefit of U.S. Provisional Application No. 62/770,578 filed Nov. 21, 2018, which is incorporated herein by reference.

BACKGROUND

A semi-automatic rifle may comprise a self-loading firearm whose action automatically cycles (i.e., ejects and rechambers) a new cartridge after each shot, but needs the operator to manually reset a hammer. The hammer needs to reset by relaxing the trigger before the next shot may be fired. Accordingly, only a single round may be discharged each time the trigger is depressed. In contrast, a fully-automatic (i.e., full-auto) rifle both cycles cartridges automatically and cycles (i.e., resets and releases) the hammer automatically as opposed to semi-auto firearms, which do only the former when the trigger is pulled. Consequently, for the duration of the trigger-pull, the full-auto rifle will fire multiple cartridges continuously until the full-auto rifle's magazine is depleted.

BRIEF DESCRIPTION OF THE FIGURES

The accompanying drawings, which are incorporated in and constitute a part of this disclosure, illustrate various embodiments of the present disclosure. In the drawings.

DETAILED DESCRIPTION

Overview

Figure 1A:
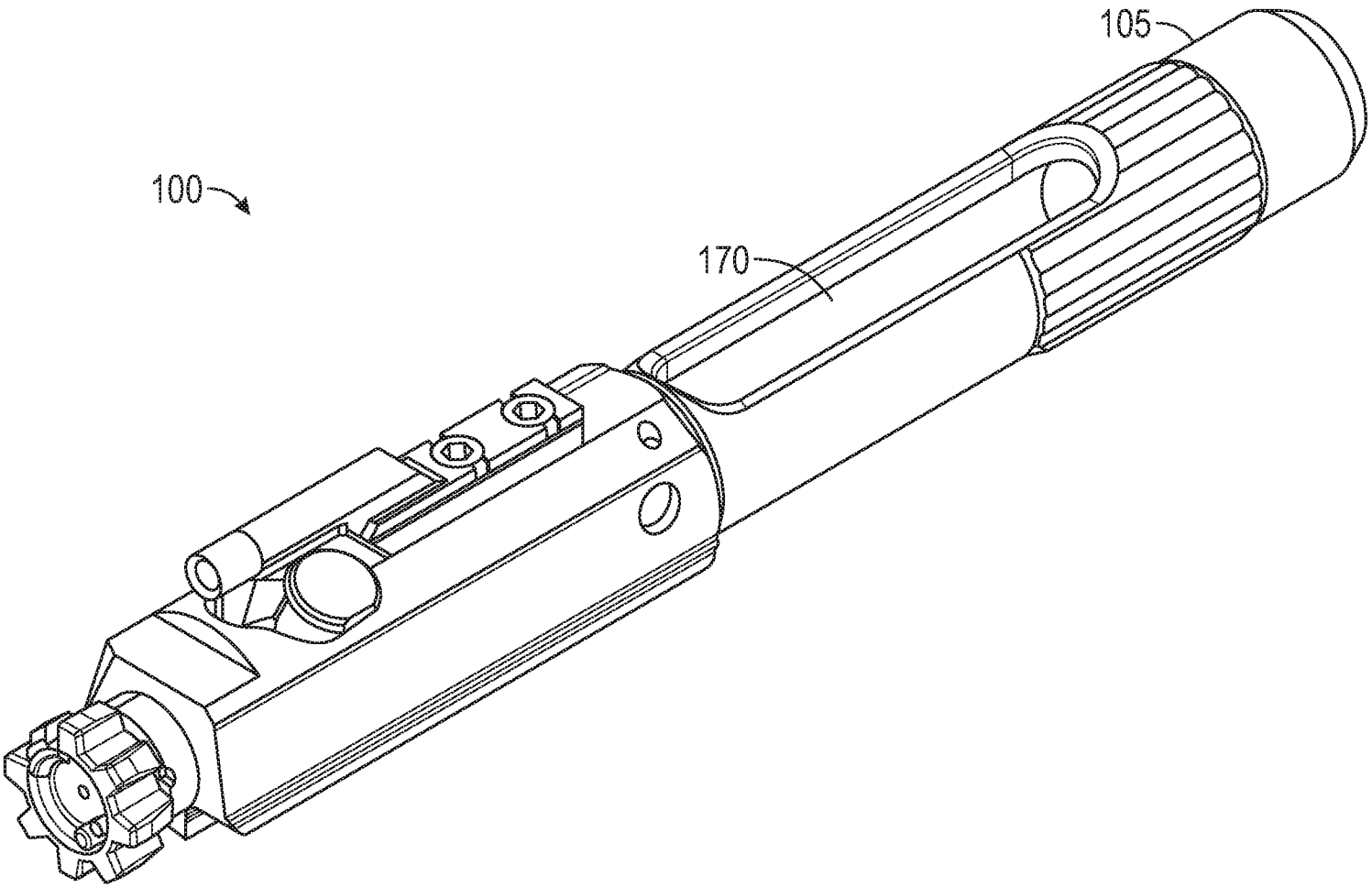
FIG. 1A shows bolt carrier.

A bolt carrier may be provided. The bolt carrier may comprise a counter-bore, a housing, a cap, and a free-floating mass. The counter-bore may be disposed in the bolt carrier. The housing may be disposed in the counter-bore. The housing may have an interior, a first end, and a second end. The cap may be disposed at the second end of the housing and may be connected to the bolt carrier. The free-floating mass is under no hydraulic or spring pressure. The free-floating mass may be slidably disposed in the housing. A length of the free-floating mass may be less than a length of the interior of the housing between the cap and the first end.

Both the foregoing overview and the following example embodiments are examples and explanatory only, and should not be considered to restrict the disclosure's scope, as described and claimed. Further, features and/or variations may be provided in addition to those set forth herein. For example, embodiments of the disclosure may be directed to various feature combinations and sub-combinations described in the example embodiments.

Example Embodiments

The following detailed description refers to the accompanying drawings. Wherever possible, the same reference numbers are used in the drawings and the following description to refer to the same or similar elements. While embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. Embodiments of the disclosure may provide a free-floating dead mass blowback system integral to a bolt carrier assembly of a semi-automatic, gas operated rifle. The free-floating dead mass blowback system consistent with embodiments of the disclosure may comprise a bolt carrier with a rear counter-bore that accepts a housing and cap and may be secured via a retaining ring and corresponding internal groove. Consistent with embodiments of the disclosure, the free-floating dead mass blowback system may allow the dynamic mass of the system to be changed according to different cartridges used by a rifle without the need for an increase in the regular reciprocating mass. By increasing the dynamic mass and reducing the regular reciprocating mass, felt recoil is lessened by splitting up the impact forces upon the shooter. More specifically, the recoil of a free-floating dead mass blowback system is split into two parts by separating some of the mass and allowing it to be free floating. This set-up reduces the impulse but also helps prevent heading towards perfect elastic collisions and prevent significant rate changes of the firearm. The set-up may also provide increased reliability by having the dynamic mass have more of an effect on the regular reciprocating mass when it is operating outside normal parameters (i.e., too fast or too slow) through collisions at different velocities. The free floating mass, for example, may comprise one or more pieces and may be solid, liquid, or in the form of a powder or any combination thereof.

Figure 1B:
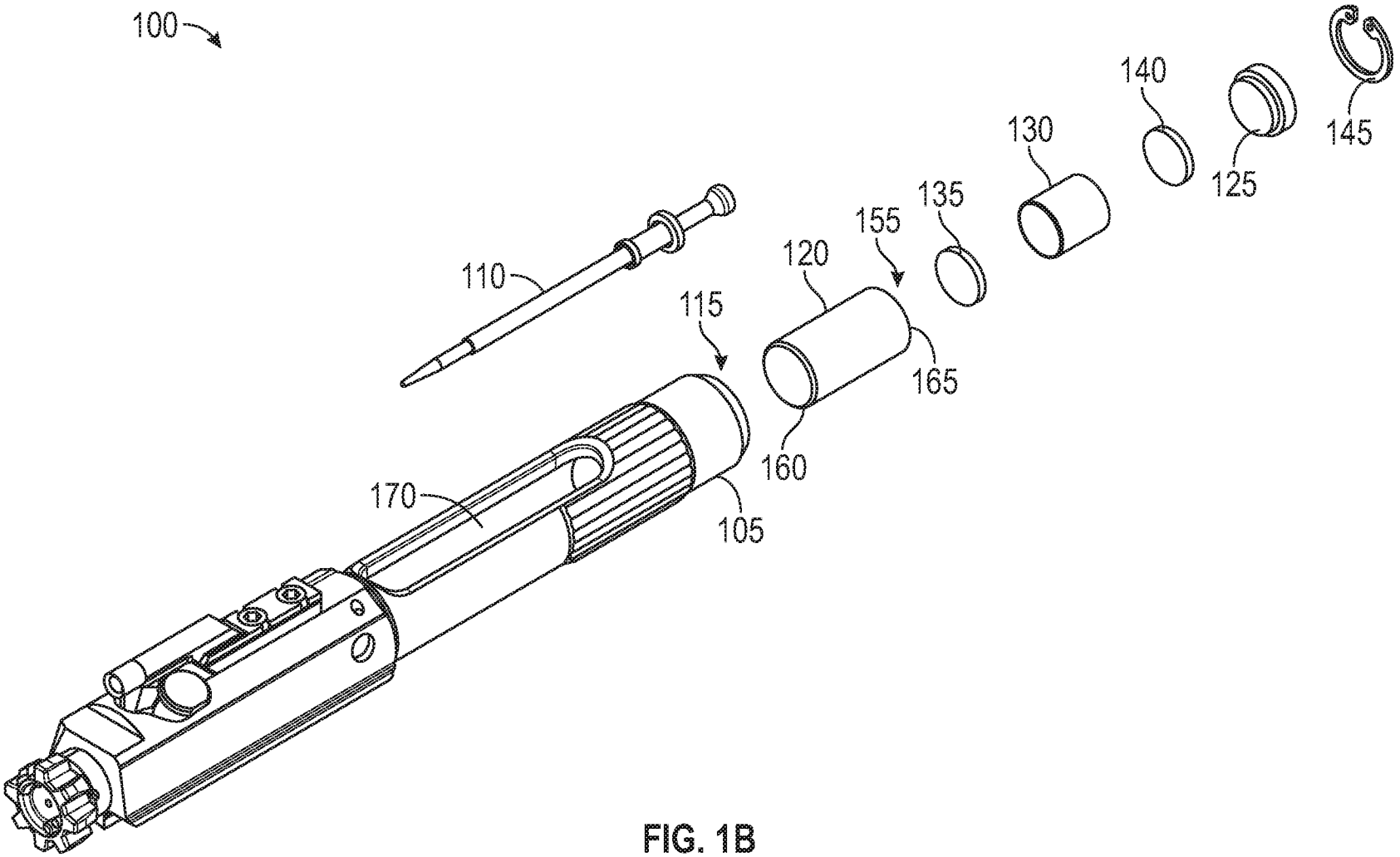
FIG. 1B shows a bolt carrier.
Figure 1C:
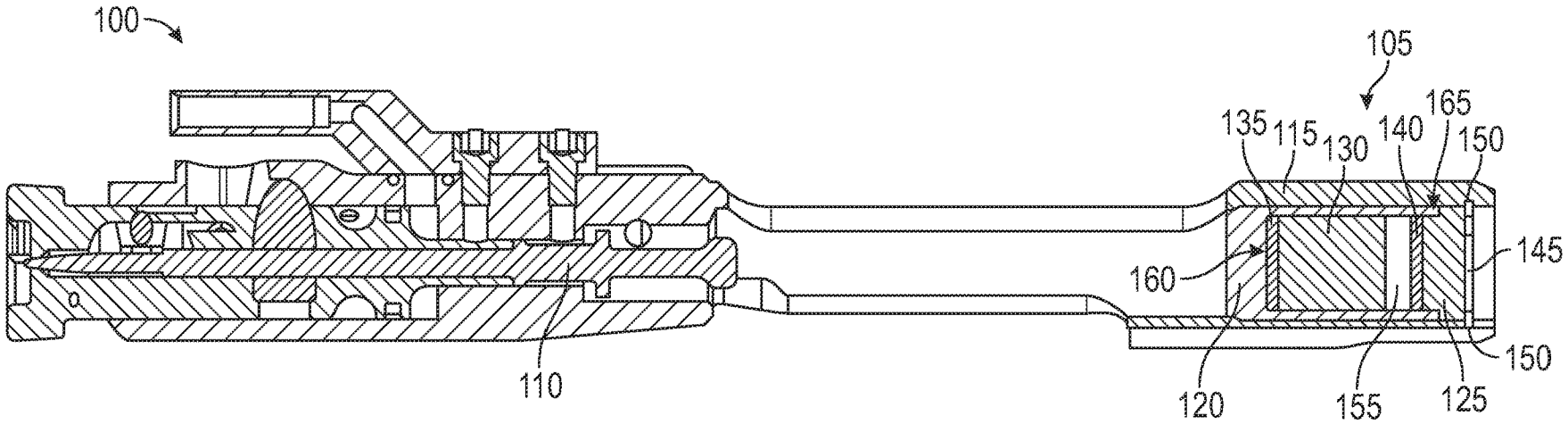
FIG. 1C shows a bolt carrier.

FIG. 1A, FIG. 1B, and FIG. 1C show a bolt carrier 100 consistent with embodiments of the disclosure for providing a free-floating dead mass blowback system. As shown in FIG. 1A, FIG. 1B, and FIG. 1C, bolt carrier 100 may comprise a rear 105, a firing pin 110, a counter-bore 115, and a housing 120. Bolt carrier 100 may further comprise a cap 125, a free-floating mass 130, a first spacer 135, a second spacer 140, and a retaining ring 145. Counter-bore 115 may comprise an internal groove 150. Housing 120 may comprise an interior 155, a first end 160, and a second end 165. Bolt carrier 100 may further comprise a top cut out 170. As shown in FIG. 1A, FIG. 1B, and FIG. 1C, bolt carrier 100 may include counter-bore 115 in rear 105 that may accept housing 120 and cap 125. Housing 120 and cap 125 may be secured in counter-bore 115 via retaining ring 145 and corresponding internal groove 150.

The connection between housing 120 and cap 125 may be airtight. This airtight fit may contain free-floating mass 130 when it is in the form of a liquid or powder. One or more O-rings or a press fit between housing 120 and cap 125 may provide this airtight fit for example. Notwithstanding, housing 120 and cap 125 may be secured by any connection means, for example, threads, pins, welds, etc. Within housing 120 and cap 125, buffer components comprising for example, free-floating mass 130, first spacer 135, and second spacer 140 may be provided. Other types of buffer components may be used and are not limited to free-floating mass 130, first spacer 135, and second spacer 140. The free-floating mass 130 may comprise, but is not limited to, tungsten. Consistent with embodiments of the disclosure, free-floating mass 130 may comprise, for example, one or more pieces and may be solid, liquid, or in the form of a powder or any combination thereof. First spacer 135 and second spacer 140 may comprise, but are not limited to, hard rubber. First spacer 135 and second spacer 140 may respectively protect first end 160 and cap 125 when free-floating mass 130 is solid, but may be omitted when free-floating mass 130 is not a solid. Additionally, the end cap 125 may compromise, but is not limited to, aluminum.

The buffer components (e.g., free-floating mass 130, first spacer 135, and second spacer 140) may be free to float within the confines of housing 120. This may allow the dynamic mass of the free-floating dead mass blowback system to be changed according to different cartridges without the need for an increase in the regular reciprocating mass. Also no axial length of any components may need to be increased. By increasing the dynamic mass and reducing the regular reciprocating mass, felt recoil may be lessened by splitting up the impact forces upon the shooter of a rifle in which bolt carrier 100 may be used. This also may provide increased reliability by having the dynamic mass have more of an effect on the regular reciprocating mass when it is operating outside normal parameters (e.g., too fast or too slow) through collisions at different velocities.

The free floating aspect of free-floating mass 130 may allow it to accelerate and transfer its kinetic energy through impacts that may act as inelastic. Free-floating mass 130 may have periods where it is at rest and housing 120 within bolt carrier 100 may slide around it. By having free-floating mass 130 impact housing 120 (and cap 125) that it resides in, free-floating mass 130 may transfer its energy through the inelastic collision that can have an additive or subtractive effect on bolt carrier 100 in motion while also transferring some to the user (e.g., shooter) by having them change the inertial reference frame.

An anti-tilt feature may be provided to bolt carrier 100. This anti-tilt feature may be provided to the bottom of rear 105 of bolt carrier 100 and also may serve as a sear trip. Firing pin 110 may be disassembled via top cut out 170.

Figure 2:
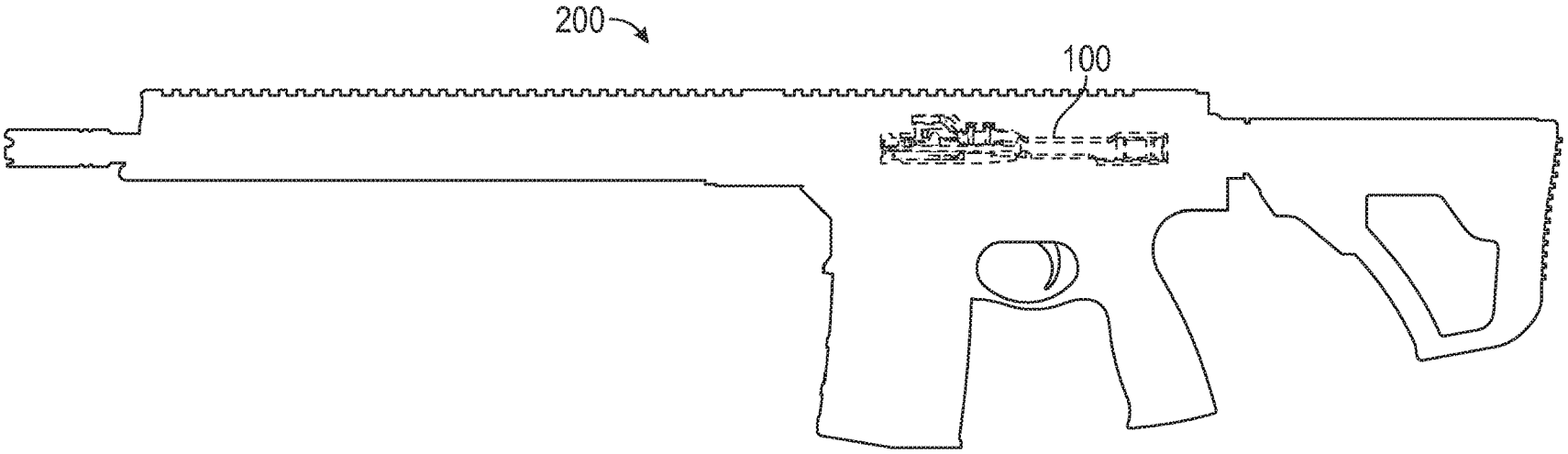
FIG. 2 shows a bolt carrier disposed in a rifle.

FIG. 2 shows a gas operated rifle 200. As shown in FIG. 2, bolt carrier 100 may be disposed in a gas operated rifle 200. Gas operated rifle 200 may comprise a self-loading firearm that may comprise, for example, a semi-automatic rifle or a fully-automatic rifle. By increasing the dynamic mass and reducing the regular reciprocating mass as described above, felt recoil may be lessened by splitting up the impact forces upon the shooter of gas operated rifle 200. The impact forces are split up over a long duration with less amplitude. Embodiments of the disclosure are not limited to rifles and may be used on other types of firearms.

Embodiments of the present disclosure, for example, are described above with reference to block diagrams and/or operational illustrations of methods and systems, according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

What is claimed is:

1. A bolt carrier comprising:

a counter-bore disposed in the bolt carrier;

a housing disposed in the counter-bore, the housing having an interior, a first end, and a second end;

a cap disposed at the second end of the housing and connected to the bolt carrier; and a single free-floating mass slidably disposed in the interior of the housing wherein a length of the free-floating mass is less than a length of the interior of the housing between the cap and the first end wherein a gap exists between the interior of the housing and the free-floating mass wherein the free-floating mass is free to float within the interior of the housing between the first end of the housing and the second end of the housing.

2. The bolt carrier of claim 1, wherein the free-floating mass is disposed between a first spacer and a second spacer in the housing, the first spacer and the second spacer each slidably disposed in the housing, wherein a sum of a length of the first spacer, the length of the free-floating mass, and a length of the second spacer is less than the length of the interior of the housing between the cap and the first end.

3. The bolt carrier of claim 1, wherein the counter-bore is disposed in a rear of the bolt carrier.

4. The bolt carrier of claim 1, wherein the cap is connected to the bolt carrier via a retaining ring disposed in an internal groove disposed in the counter-bore.

5. The bolt carrier of claim 1, wherein the free-floating mass comprises tungsten.

6. The bolt carrier of claim 1, wherein a weight of the free-floating mass is matched to a cartridge size for which the bolt carrier corresponds to.

7. The bolt carrier of claim 1, wherein the bolt carrier is disposed in a semi-automatic, gas operated rifle.

8. A bolt carrier comprising:

a counter-bore disposed in the bolt carrier, the counter-bore having an interior, a first end, and a second end;

a cap disposed at the second end of the counter-bore and connected to the bolt carrier; and a single free-floating mass slidably disposed in the interior of the counter-bore wherein a length of the free-floating mass is less than a length of the interior of the counter-bore between the cap and the first end wherein a gap exists between the interior of the counter-bore and the free-floating mass wherein the free-floating mass is free to float within the interior of the counter-bore between the first end of the counter-bore and the second end of the counter-bore.

9. The bolt carrier of claim 8, wherein the free-floating mass is disposed between a first spacer and a second spacer in the counter-bore, the first spacer and the second spacer each being slidably disposed in the counter-bore, wherein a sum of a length of the first spacer, the length of the free-floating mass, and a length of the second spacer is less than the length of the interior of the counter-bore between the cap and the first end.

10. The bolt carrier of claim 8, wherein the counter-bore is disposed in a rear of the bolt carrier.

11. The bolt carrier of claim 8, wherein the cap is connected to the bolt carrier via a retaining ring disposed in an internal groove disposed in the counter-bore.

12. The bolt carrier of claim 8, wherein the free-floating mass comprises tungsten.

13. The bolt carrier of claim 8, wherein a weight of the free-floating mass is matched to a cartridge size for which the bolt carrier corresponds to.

14. The bolt carrier of claim 8, wherein the bolt carrier is disposed in a semi-automatic, gas operated rifle.

15. A bolt carrier comprising:

a counter-bore disposed in the bolt carrier;

a housing disposed in the counter-bore, the housing having an interior, a first end, and a second end;

a cap disposed at the second end of the housing and connected to the bolt carrier; and a single free-floating mass slidably disposed in the interior of the housing wherein the free-floating mass is disposed between a first spacer and a second spacer in the housing, the first spacer and the second spacer each slidably disposed in the housing, wherein a sum of a length of the first spacer, a length of the free-floating mass, and a length of the second spacer is less than a length of the interior of the housing between the cap and the first end wherein a gap exists between the interior of the housing and the free-floating mass wherein the free-floating mass is free to float within the interior of the housing between the first end of the housing and the second end of the housing.

16. The bolt carrier of claim 15, wherein the counter-bore is disposed in a rear of the bolt carrier.

17. The bolt carrier of claim 15, wherein the cap is connected to the bolt carrier via a retaining ring disposed in an internal groove disposed in the counter-bore.

18. The bolt carrier of claim 15, wherein the free-floating mass comprises tungsten.

19. The bolt carrier of claim 15, wherein a weight of the free-floating mass is matched to a cartridge size for which the bolt carrier corresponds to.

20. The bolt carrier of claim 15, wherein the bolt carrier is disposed in a semi-automatic, gas operated rifle.

* * * * *